United States Patent [19]

Yuza

[11] Patent Number: 4,630,022

[45] Date of Patent: Dec. 16, 1986

[54] ELECTRIC FUSE FOR HIGH VOLTAGE CIRCUIT

[75] Inventor: Yasutada Yuza, Namiki, Japan

[73] Assignee: S.O.C. Corporation, Tokyo, Japan

[21] Appl. No.: 700,506

[22] Filed: Feb. 11, 1985

[30] Foreign Application Priority Data

Feb. 14, 1984 [JP] Japan ..... 59-24320

[51] Int. Cl.[4] ..... H01H 85/38

[52] U.S. Cl. ..... 337/282; 337/250; 337/158

[58] Field of Search ..... 337/282, 281, 280, 279, 337/278, 273, 227, 228, 229, 249, 250, 231, 232, 233, 158, 159

[56] References Cited

U.S. PATENT DOCUMENTS 1,972,357 9/1934 Pittman ..... 337/250

*Primary Examiner*—Harold Broome

[57] ABSTRACT

An electric fuse for high voltage circuit comprises an insulative tubular casing closed at both ends with metal caps and has an insulative cylindrical member within said tubular casing disposed eccentrically and is offset relative to the major axis of said tubular casing so as to define an annular space therewith which is non-uniform in width. The annular space has a wider portion on one side of said tubular member and a narrower portion on the other side thereof. A fusible element is stretched in said narrower portion of said annular space and is secured at both ends to said metal caps.

4 Claims, 3 Drawing Figures

ELECTRIC FUSE FOR HIGH VOLTAGE CIRCUIT

FIELD OF THE INVENTION

This invention relates generally to electrical fuses and in particular to small size electric fuses for high voltage circuits. The invention is concerned with a fuse having improved current interruption and fusing characteristics by virtue of unique construction and arrangements of the various parts of the fuse assembly.

BACKGROUND OF THE INVENTION

It is common practice in high voltage circuits to use fuses which contain arc extinguishing materials. Thus, when the fusible element (usually a metal wire) melts due to the passage of an overload current, the metal wire is fragmented and the metal particles cause arcing within the fuse casing. Arcing can be both dangerous and damaging to the circuit. The arc extinguishing materials in the fuse serve to cool and extinguish the arc.

Although a variety of arc extinguishing materials have been proposed and used with some measure of success, in practice there are several drawbacks and disadvantages associated with these fuses. One such drawback is the breakdown of the fusible wire element. This is because the fusible wire element is subjected to frequent thermal expansions and contractions resulting from variations in current loads in the circuit. Since the ends of this fusible element are securely fixed to the terminals of the fuse, the thermal expansion and contraction of the fuse produces stresses and strains within the fusible wire element which eventually causes a breakdown of the wire due to so-called elasticity fatigue. Even though the foregoing phenomena are experienced regardless of whether arc extinguishing materials are used or not, the use of arc extinguishing materials aggravate the problem. This is because the fusible wire element is usually densely surrounded by the arc extinguishing materials and hence the wire is prevented from movement and cannot relieve the stresses and strains produced in its structure.

The use of arc extinguishing materials involve other disadvantages. For example, the surface of the fusible wire element can be damaged due to abrasion caused by continued contact with the moving particles of the arc extinguishing materials which are usually in granular or pulverized forms. Also, the movements of the arc extinguishing particulate matters in the casing due to the aforementioned thermal cycles result in localized changes in volume and contact points from time to time, thus resulting in unstable fusing characteristics.

The use of arc extinguishing materials may even be detrimental in some instances, such as when the overcurrent is not sufficiently strong, i.e., it is lower than a certain limit, and thus a so-called "insulating distance" is not attained. By "insulating distance" is meant a wide gap between the melted tips of the fusible wire element so that no further arcing takes place and the current is thus interrupted. The metal particles generated due to melting of the fusible wire element are trapped by the arc extinguishing materials, are wafted near the fusible wire element and cause repeated arc generation. Such prolonged arcing tends to overheat and thus melt the arc extinguishing materials therefore reducing the insulating capacity of the arc extinguisher and often results in failure of interruption.

It is therefore an object of this invention to provide a fuse which is free from the aforementioned drawbacks and limitations.

It is a further object of this invention to provide a fuse which does not contain arc extinguishing materials.

It is still another object of this invention to provide a fuse which does not require the use of arc extinguishing materials due to its unique construction and the novel arrangements of its various components.

It is yet a further object of this invention to provide a fuse having a novel construction and excellent fusing and current interruption characteristics.

The foregoing and other features and advantages of this invention will be more fully comprehended from the following detailed description and the accompanying drawings.

SUMMARY OF THE INVENTION

In accordance with this invention, there is provided a fuse having a unique construction designed to obviate the aforementioned drawbacks. This fuse comprises a tubular casing made of an insulative material which is closed at both ends by metal caps such as, e.g., ferrules, which serve as electrodes for the fuse. Within the tubular casing there is placed an insulative cylindrical member disposed eccentrically relative to the major axis of the tubular casing so as to define an annular space having a generally crescent configuration. If viewed in cross-section, the annular space has the widest portion on one side of the tubular member and the narrowest portion on the opposite side of said tubular member, the widest portion being several times wider than the narrowest portion, with portions of intermediate width therebetween. A fusible element is stretched through said narrower portion of said annular space and is secured at both ends to the end caps by solder.

By virtue of its unique construction, the fuse of this invention exhibits stable fusing characteristics, improved current interruption and excellent fusing properties without using arc extinguishing materials in the fuse.

BRIEF DESCRIPTION OF THE DRAWINGS

In the drawings, wherein like reference numerals designates like parts.

DETAILED DESCRIPTION OF THE INVENTION

Figure 1:
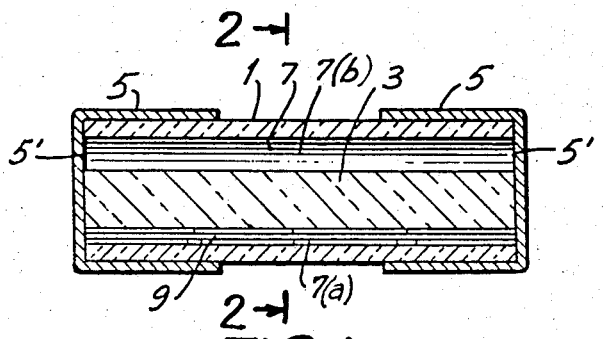
FIG. 1 is a longitudinal sectional view of a fuse constructed in accordance with the present invention.

Referring first to FIG. 1, there is shown a fuse having a tubular casing 1 made of an insulative material. Within the tubular casing 1 there is disposed a generally cylindrical member 3 which is substantially coterminus with said tubular casing 1. The ends of the tubular casing 1 and the cylindrical member 3 are closed with the metal caps 5,5 by any of the conventional means known in the art.

A novel and unique feature of the fuse shown in FIG. 1 resides in the manner of disposition of the cylindrical member 3 within the tubular casing. Thus, in accordance with the present invention, the cylindrical member 3 is disposed eccentrically and is offset relative to the longitudinal axis of the tubular casing 1 such as to define a unique and generally crescent-shaped annular space 7 with the wall of the tubular casing. As showin in FIGS. 2 and 3, the annular space 7 has its narrowest path or portion 7(*a*) on one side of the cylindrical member 3, its widest path or portion 7(*b*) on the other side and paths or portions 7(*c*) and 7(*d*) of intermediate widths between portions 7(*a*) and 7(*b*). The advantages of this construction will become more apparent from the ensuing discussion.

Figure 2:
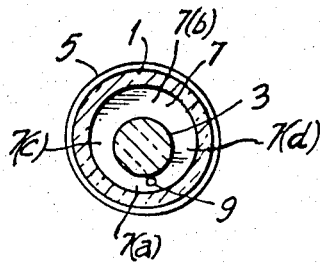
FIG. 2 is a transverse sectional view taken along the line 2—2 of FIG. 1.

As is further shown in FIGS. 1 and 2, a fusible element 9 (e.g., a wire) is stretched through the narrow portion 7(*a*) of the cylinder member 3. The ends of the fusible element 9 are secured to the inside of the end metal caps 5,5 such as by soldering (not shown) each end of the fusible wire element 9 to the inner walls 5', 5' of the end metal caps. The metal caps 5,5 thus act as conductors or electrodes.

Figure 3:
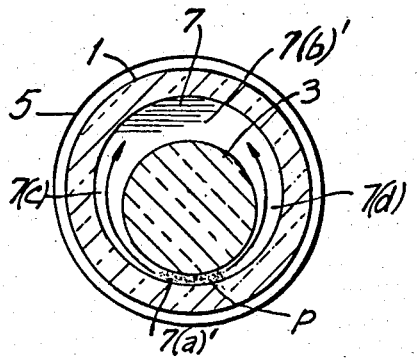
FIG. 3 is the same view as FIG. 2 but in exaggerated dimensions in order to illustrate the flow path of the metal particles resulting from melting of the fusible element due to current overload.

When an overcurrent in the circuit causes the fusible wire element 9 to melt, the melted wire vaporizes and metal particles become entrapped in the vapor. With reference to FIG. 3, these metal particles are designated as P. Since the pressure within the narrowest portion 7(*a*) is greater than the pressure within the intermediate portions 7(*c*) and 7(*d*), which are, in turn, at higher pressure than the widest portion 7(*b*), the metal particles diffuse in the metal vapor and are wafted in the direction of the arrows (see FIG. 3), i.e., from the narrowest portion 7(*a*) through the intermediate portions 7(*c*) and 7(*d*) toward the widest portion 7(*b*). This circumferential flow of the metal particles through the annular space 7 results in decreased density or accumulation of metal particles at the end metal caps 5,5 and greater distance between the fragmented metal particles, with less arcing tendency. The metal particles P will be cooled by contact with, or adhering to, the surfaces of tubular casing 1 and the cylindrical member 3. Consequently, insulation within the tubular casing is improved and the electric current is interrupted before a large arc is generated.

A fuse having the novel construction described herein can be successfully used in high voltage circuits to interrupt overcurrents without filling the fuse casing with arc extinguishing materials. In fact, a fuse constructed in accordance with this invention, which is only 2.6 mm in diameter and 12 mm in length, having a current rating of 500 mA, can successfully interrupt a short circuit of 50 amperes and 650 volts.

Thus, in accordance with the present invention, there is provided a fuse which, due to its unique construction, has several highly desirable attributes particularly when used in high voltage circuitries. The fuse of this invention maintains stable fusing characteristics notwithstanding variations of the current load or changes in the thermal cycle (repeated thermal expansions and contractions) under the prevailing conditions of use of the fuse. In addition, the fuse of the present invention exhibits excellent current interruption characteristics and fusing characteristics without using arc extinguishing materials.

As it can be appreciated from the foregoing description and the drawings several changes and modifications may be made in the structure of the fuse which are obvious from the present disclosure. Such changes and modifications are nevertheless within the scope of this invention.

What is claimed is:

1. An electric fuse comprising a tubular casing made of an electrically insulative material, an insulative cylindrical body member disposed within said tubular casing in an eccentric and offset position relative to the major axis of said tubular casing, said insulative cylindrical member defining an annular space with said tubular casing, said annular space being non-uniform in width and having, when viewed in cross-section, its widest portion on one side of the tubular member and its narrowest portion on the opposite side of said tubular member, metal caps at each end of said tubular casing and a fusible element stretched in said generally narrower portion of said annular space and secured at both ends to said metal caps.

2. A fuse as in claim 1 wherein said annular space has a generally crescent configuration.

3. A fuse as in claim 1 wherein said fusible element is soldered at both ends to said metal caps.

4. A fuse as in claim 2, wherein said fusible element is soldered at both ends to said metal caps.

* * * * *